United States Patent [19]

Kobayashi et al.

[11] Patent Number: 4,638,600

[45] Date of Patent: Jan. 27, 1987

[54] MULTI-FUNCTION WORK FINSHING MACHINE USING BARREL CONTAINERS

[75] Inventors: Hisamine Kobayashi; Katsuhiro Izuhara, both of Nagoya, Japan

[73] Assignee: Lipton Manufacturing Corporation, Nagoya, Japan

[21] Appl. No.: 717,293

[22] Filed: Mar. 28, 1985

[30] Foreign Application Priority Data

Oct. 16, 1984 [JP] Japan ..... 59-217143

[51] Int. Cl.[4] ..... B24B 31/02

[52] U.S. Cl. ..... 51/164.2; 241/176

[58] Field of Search ..... 51/164.1, 164.2; 241/175, 176

[56] References Cited

U.S. PATENT DOCUMENTS

| | | | |
|---|---|---|---|
| 2,600,282 | 6/1952 | Strong | 51/164.1 |
| 3,233,372 | 2/1966 | Kobayashi . | |
| 3,513,604 | 5/1970 | Matsunaga et al. . | |
| 3,579,920 | 5/1971 | Heiberger | 51/164.2 |
| 3,823,512 | 7/1974 | Kobayashi | 51/164.2 |
| 3,855,740 | 12/1974 | Kobayashi . | |
| 4,104,831 | 8/1978 | Kobayashi . | |
| 4,232,486 | 11/1980 | Rampe | 51/164.1 |

*Primary Examiner*—Harold D. Whitehead

*Attorney, Agent, or Firm*—Wenderoth, Lind & Ponack

[57] ABSTRACT

A multi-function barrel finishing machine includes a central work processing section which is supported by a tiltable main spindle from horizontal to vertical or to inclined positions, and vice versa, the central work processing section including a turret rotatably supported by the main spindle and a plurality of barrel containers carried by the turret and which are capable of both axial rotation about their own axes, and orbital revolution about the main spindle. A single machine construction incorporates the various functions provided by the individual machines such as the horizontal-type high-speed centrifugal or planetary revolving barrel finishing machine, vertical-type high-speed centrifugal barrel finishing machine, horizontal-type rotating barrel finishing machine, and tiltable-type rotating barrel finishing machine. Those functions may be selected and performed singly or in any combination, depending upon the particular work processing requirements. The work processing functions performed by the machine include the work surface finishing, deburring, stirring, mixing, and milling. The machine includes optional automatic lid opening and reclosing for all barrel containers, a mass charging device, and a mass separator. All the functions of the machine are automatic and are performed sequentially.

9 Claims, 14 Drawing Figures

MULTI-FUNCTION WORK FINSHING MACHINE USING BARREL CONTAINERS

BACKGROUND OF THE INVENTION

1. Field of the Invention

The present invention relates to a work finishing machine which provides the work processing functions such as surface-finishing, stirring, mixing, and milling against the work pieces contained in the individual barrel containers. The manufacture and application of such a machine are covered by the present invention.

2. Description of Related Art

Conventional work finishing machines are designed and built to meet the specific work processing needs, and in this sense there are various types of machines. For example, the high-speed centrifugal barrel finishing machine has a horizontally-disposed main spindle which drives the barrels for revolution about it (U.S. Pat. No. 3,233,372). Another type of the machine has a vertically-disposed main spindle (U.S. Pat. No. 4,104,831).

For the vertical-type machine, the barrels revolve about the vertical main spindle. The specific feature of this machine is the fact that the content or mass (which consists of work pieces to be processed and usually their abrasive media, the mixture of which will hereinafter be referred to as the "content" or "mass", except otherwise specified in some applications where work pieces alone are to be processed) contained in the individual barrels is gradually rising or falling along the outer peripheral wall inside the barrel, which corresponds to the virtual revolution line formed when the barrels revolve around the main spindle. Therefore, less physical impact upon the work pieces is produced than for the first-mentioned horizontal-type machine, at the time of start-up and stop. It has been practically proven that the vertical-type machine is particularly suited to process work pieces of fragile materials that tend to cause defects such as chips and cracks.

For the horizontal-type machine, on the other hand, the individual barrels are supported at the opposite ends of the horizontally-disposed main spindle. As such, good bearing durability and good workability are provided. Both types provide their own specific features.

There are also two types of rotating barrel machines, one having a horizontally-disposed main spindle and the other having an inclined main spindle. The horizontal-type is widely used, and provides a high surface finish for the work pieces although its finishing efficiency is several times less than the high-speed centrifugal barrel finishing types.

The inclined-type enables the whole mass in each of the individual barrels to have a sliding movement nearly all of the time, and provides an improved deburring function. In addition, this type may be used for handling thin and/or flat work pieces, since it ensures the smooth flow of the work pieces without causing the work pieces to stick onto the inner wall of the barrel. Both types provide their specific features, respectively.

SUMMARY OF THE INVENTION

The present invention takes full advantage of the specific features of the above-mentioned different machine types selectively or in any combination. By integrating those features or functions into a single machine construction, they can be selected and performed singly or in sequence, depending upon the particular work processing requirements.

It is therefore one object of the present invention to offer a multi-function barrel finishing machine which incorporates the functions provided individually by the horizontal-type high-speed centrifugal barrel finishing machine, vertical-type high speed centrifugal barrel finishing machine, horizontal-type rotating barrel finishing machine, and tiltable-type barrel finishing machine. The machine includes a main spindle which supports a central work processing section tiltably from horizontal to vertical or to inclined positions, and vice versa, the central work processing section including a turret secured to a main spindle and carrying a plurality of barrel containers. Each of the barrel containers is supported by its own axis, and is capable of both axial rotation around its own axis and orbital revolution around the main spindle. The above-mentioned functions can be selected by varying the angular position of the main spindle, such as from horizontal to vertical or to inclined positions and vice versa.

It is another object to provide a full-automatic machine that includes an optional means that permits automatic lid opening and reclosing for all barrels, a mass charging section, and a mass separator. All operations including the mass charging, work finish processing sequence and mass separation are performed sequentially. As a total system, the present invention combines all the specific functions offered by the different machines, thereby satisfying the requirements for those individual machines simultaneously. Thus, a problem such as floor space limitation is solved.

Generally, the multi-function machine offered by the present invention comprises a central work processing section, and an accompanying section surrounding the central work processing section. The central work processing section includes a tiltable main spindle, a turret secured to the main spindle perpendicularly to the longitudinal direction of the main spindle, the turret bearing a plurality of barrel shafts arranged at equally spaced angular positions around the circumference of the turret, each of the sheets rotatably supporting a barrel container, means for causing the tilting of the main spindle, separate drive means for causing the rotation of the corresponding main spindle and the barrel shafts, and optionally means for permitting automatic lid opening and reclosing for all barrels which is formed like a rotary panel, the rotary panel being supported by the main spindle rotatably as well as slidably with respect to the longitudinal direction of the main spindle and including means for allowing the barrel lids to be moved closer to the barrels above and away from the same. The accompanying section includes a mass charging device above the central work processing section and a mass separator below it.

More specifically, the means for causing the reversing or tilting of the main spindle includes a yoke having a central shaft traversing it to support the main spindle and in which the central work processing section is accommodated, a yoke shaft supporting the yoke on its lateral sides, and means for driving the yoke for indexed rotation. In its alternative form, the means includes a pair of rolling plates having a central shaft across them to support the main spindle and in which the central work processing section is accommodated, rollers rotatably supporting the rolling plates, and means for driving the rollers.

The features of the present invention may be summarized as follows. One feature isi to allow a specific operation or a series of specific operations to be selected, depending upon the particular work processing needs. This is accomplished by causing the barrels only to rotate on their axes (rotating barrel finishing), or by causing the barrels both to rotate on their axes and to revolve around the main spindle (centrifugal barrel finishing), or by causing the whole central work processing section to be tilted by varying the angle of the main spindle (tiltable barrel finishing). A single step may be performed or two or more steps may be performed sequentially in a single machine.

Another feature is to permit automatic lid opening and reclosing for all barrels at one operation, thus allowing the mass to be put into all the barrels simultaneously and allowing the mass to be discharged at one time from all the barrels onto the mass separating sieve. The two combined features make all the operations automatic.

BRIEF DESCRIPTION OF THE DRAWINGS

These and other objects and features will become more apparent from the detailed description of the several preferred embodiments that follows hereinafter by referring to the accompanying drawings, in which.

DETAILS OF THE PREFERRED EMBODIMENTS

The following is a detailed description of several preferred embodiments of the present invention. FIGS. 1 through 7 illustrate one form of the construction of the machine according to the present invention, which includes the optional means that permits automatic lid opening and closing for all the barrels. FIGS. 8 through 14 illustrate the construction of a variation of the machine without the above optional means.

Figure 1:
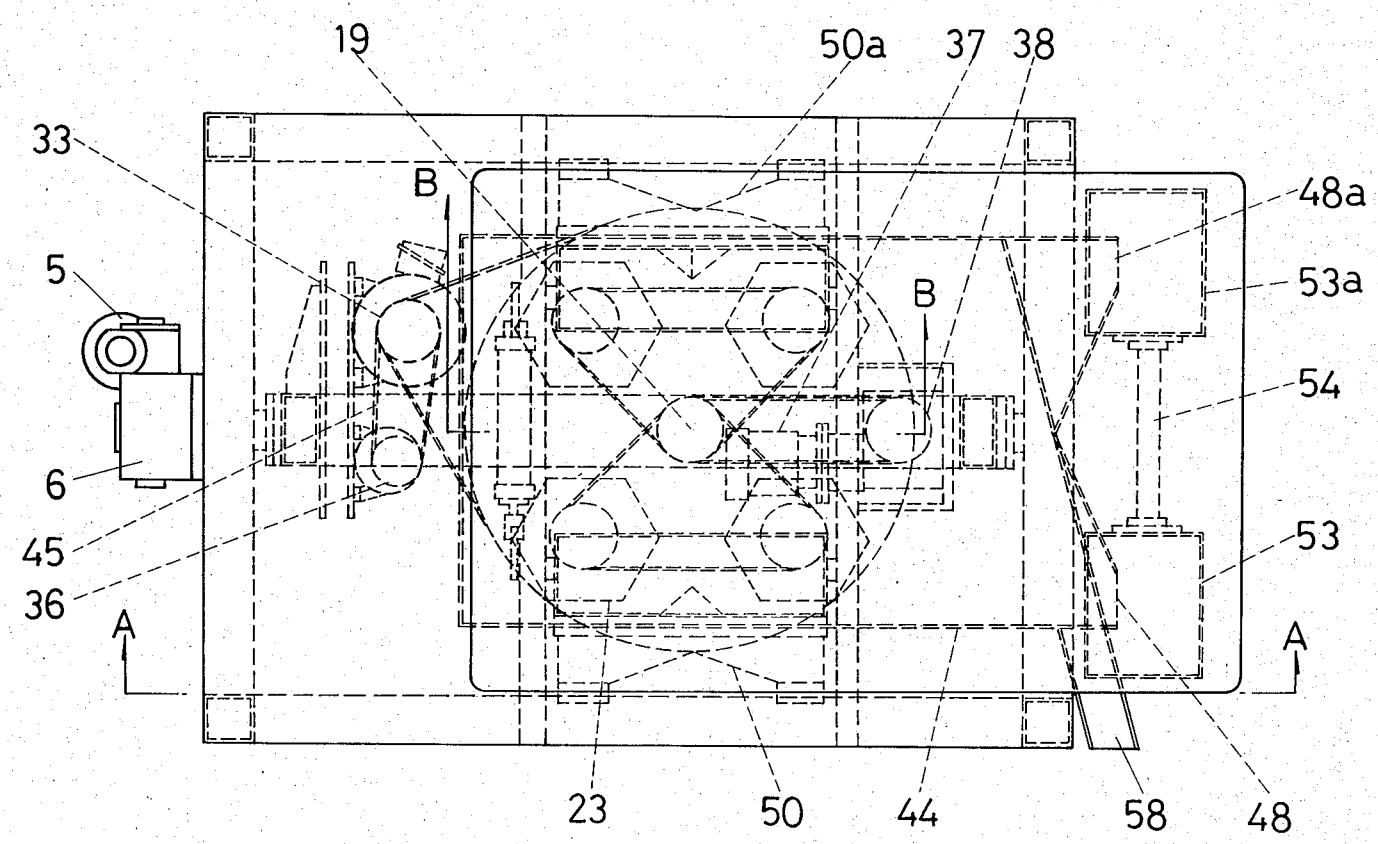
FIG. 1 presents an overview outlining the construction of the full-automatic multi-function machine embodying the present invention, as seen from its plan view.
Figure 2:
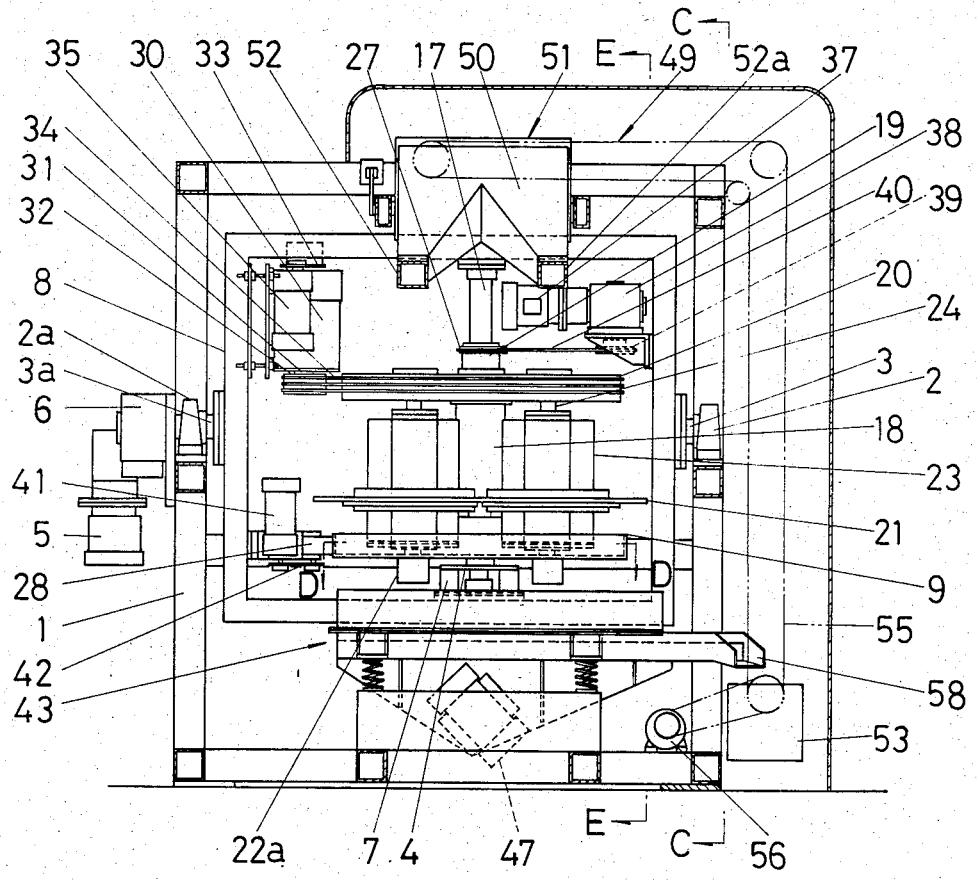
FIG. 2 is a front elevation of the machine in FIG. 1.

The first embodiment is now described by referring to FIGS. 1 through 7. In FIG. 2, the portion which forms the principal part of the machine is accommodated within a machine pedestal 1 formed by frames. A yoke 8 is rotatably supported on its opposite lateral sides by means of horizontally-disposed yoke shafts 3, 3*a* which are in turn rotatably supported by their respective bearings 2, 2*a* which are secured to the lateral sides of the machine pedestal 1. The opposite end of one of the yoke shafts, as indicated by 3*a* in FIG. 2, is operatively associated with reduction gears 6, which are coupled to a yoke indexing motor 5. Thus, the rotation of the yoke 8 is controlled by the combination of the shaft 3*a*, reduction gears 6 and motor 5. The yoke 8 has a plurality of tapered apertures (not shown) at appropriate positions, which correspond to the vertical, horizontal, and inclined positions of the yoke 8. The corresponding number of fluid-operated cylinders (not shown) are provided on the machine pedestal 1 at the positions corresponding to the above different positions of the yoke 8. Each of the cylinders has an extensible and retractable piston rod, to the forward end of which an engaging member is secured. Each of those engaging members engages the corresponding tapered aperture on the yoke 8, thereby determining the corresponding vertical, horizontal, or inclined position of the yoke.

Figure 4:
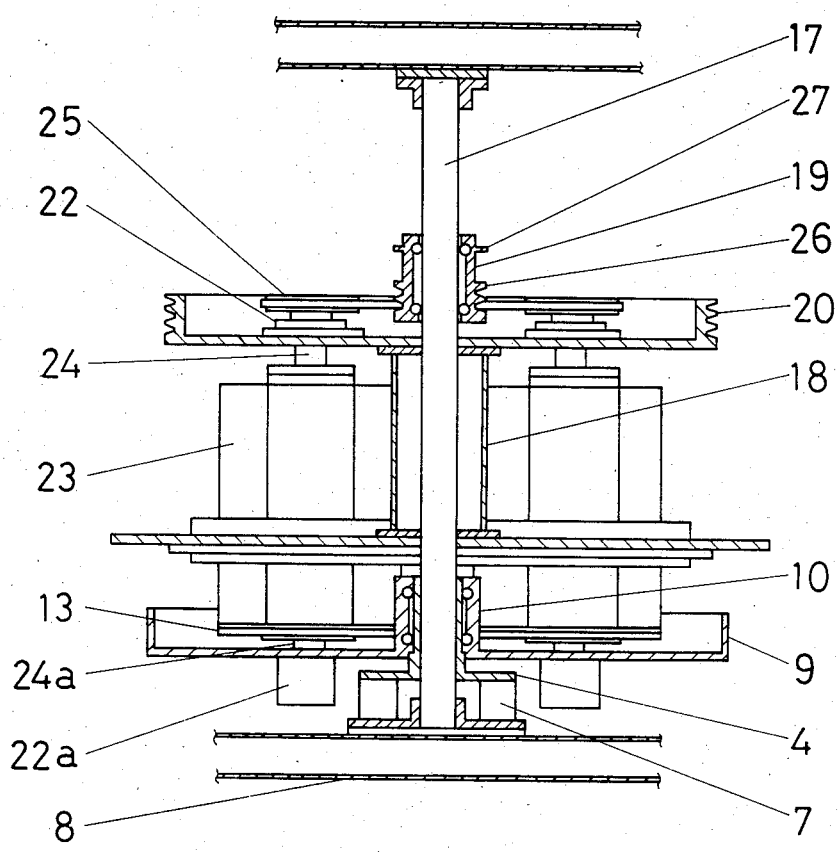
FIG. 4 illustrates the details of the drive section for the barrels, as sectioned longitudinally.
Figure 5:
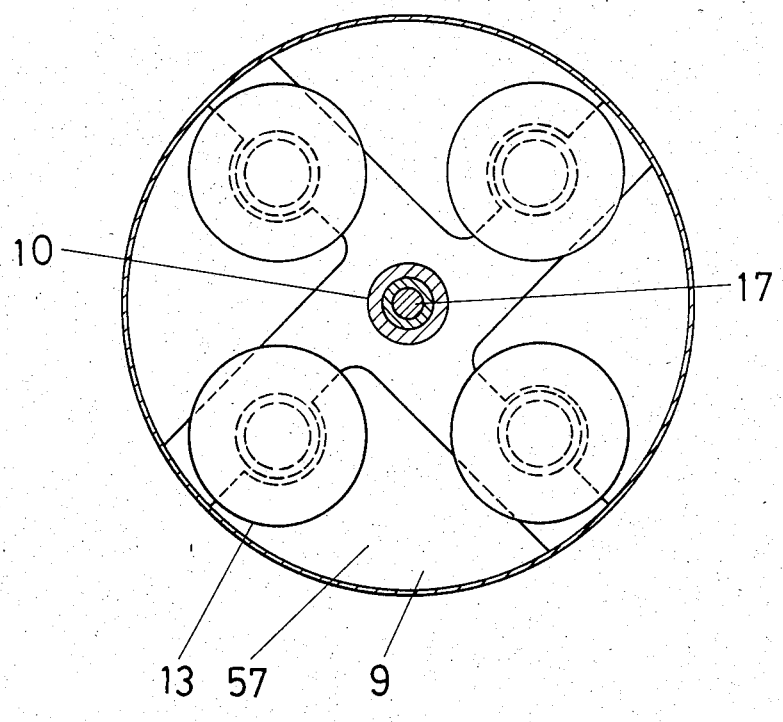
FIG. 5 is a sectional view of the part forming a rotary panel.

The yoke 8 has a central shaft 17 having a central axis across it, whose opposite ends are fixed to the corresponding sides of the yoke. The central shaft 17 has a main spindle 18 which is rotatable about the central axis of the shaft 17 and which is fitted around the intermediate longitudinal portion of the shaft 17 so that the main spindle 18 can rotate freely with regard to the shaft 17. The main spindle 18 includes a farrel driving wheel 19, which is fitted around and rotatable the main spindle on one end thereof so that it can be driven for rotation. Furthermore, the main spindle includes a turret driving wheel 20 and a circular turret 21, which are secured to the main spindle at a distance in the longitudinal direction of the main spindle. The turret driving wheel 20 has a plurality of bearings 22 (in the example shown in FIG. 1, four bearings are provided) at equally spaced angular positions which are equidistant from the center of the wheel 20. As shown in FIG. 4, barrel shafts 24 for barrel containers 23 are rotatably supported by the corresponding bearings 22 which are offset from the central axis of the shaft 17. Each of the barrel shafts 24 has a driving wheel 25, which is secured to one end of the shaft 24 on the turret side. The barrel driving wheel 19 includes a driving wheel 26 at one end thereof which has two pulley sections, each of which is associated with half the number of the barrel containers. A driving wheel 27 which is provided at the other end of barrel driving wheel 19 so that it can be driven by a motor which will be described later.

On the opposite end of the central shaft 17, on the end at which the turret driving wheel 20 is located as described above, a rotary panel 9 is provided, which is rotatably supported by a bearing 10 slidably fitted around the central shaft 17 and is capable of sliding movement in the longitudinal direction of the shaft 17. Similarly to the turret driving wheel 20, the rotary panel 9 has a plurality of bearings 22*a* at equally spaced angular positions around the same circumference thereof, the positions corresponding to those of the bearings 22 on the turret driving wheel 20. Each of the bearins 22*a* supports a barrel shaft 24*a* so that it can be rotated, the barrel shaft 24*a* having a barrel lid 13.

Each of the barrel containers 23 has an opening 12, which is shown at the bottom in FIG. 4, and the opening 12 is opened and reclosed by the lid 13 by lowering and raising the rotary panel 9. To this end, a mounting plate 4 is provided below the bearing 10 supporting the rotary panel 9. The mounting plate 4 is fitted around the central shaft 17 so that it can be moved slidably up and down along the length of the shaft 17. The sliding movement of the mounting plate 4 is accomplished by means of the piston rods of two thin-type fluid-operated cylinders 7, 7 which are provided on the yoke 8. The piston rods are fixed to the bottom of the mounting plate 4. As such, when a pressurized fluid is introduced into the piston side of the cylinders 7, 7, the mounting plate 4 is pushed forward by the piston rods from below, and is brought in contact with the bearing 10. Thus, the bearing 10 is also pushed forward, moving the rotary panel 9 toward the barrel containers 23. The rotary panel 9 is raised until the barrel lid 13 is brought in intimate contact with the opening 12 of the barrel container 23. The distance of travel of the rotary panel 9 is defined by the stroke of the pistons or their rods of the cylinders 7, 7. In order to keep the barrel container hermetically sealed, the edge of the opening 12 and the lid 13 are lined with rubber or other similar materials. A roller 28 is provided on one lateral side of the rotary panel 9. This roller 28 is pivotted to a pin (not shown) which is mounted to the yoke 8, and drives the rotary panel 9 for rotation by contacting the peripheral edge of the latter. The rotation of the roller 28 is caused by its associated barrel lid indexing motor 41 and intermediate belt 42 which connects the roller and motor.

The drive section which supplies the driving power for the moving parts of the machine is now described. The details of the drive section are presented particularly in FIG. 2, wherein a main motor 30 with a vertical shaft 31 and a brake-controlled geared motor 35 for indexing the turret are bolted by means of their common base plate to the lateral inner wall of the yoke 8, the two motors 30 and 35 being arranged side by side on the base plate. The main motor 30 has a pulley 32 which is rigidly secured to the bottom end of its vertical shaft 31, and a power transmission belt 34 is threaded around the pulley 32 on one side and around the turret drive wheel 20 on the other side. Thus, the driving power supplied by the main motor 30 is directly transmitted by means of the belt 34 and through the turret drive wheel 20 to the turret 21. The main motor 30 also has an electromagnetically acutated clutch-controlled sprocket 33 which is rigidly secured to the top end of the vertical shaft 31. The brake-controlled geared motor 35 has a sprocket 36 (FIG. 1) rigidly secured to the top end of its shaft (not shown). The sprockets 33 and 36 are linked by means of a sprocket chain 45 which engages the two sprockets. As such, the geared motor driving power is transmitted from the main motor 30 through the sprocket chain 45 to the geared motor 35. A motor assembly 37 is mounted on a bracket which is secured to the yoke 8 and includes reduction gears 38 coupled to the motor 37. The motor 37 and the reduction gears 38 drive the barrel containers for their own axial rotation. The reduction gears 38 have an output shaft which carries a wheel 39, and the wheel 39 is linked to its associated wheel 27 by means of a linkage chain 40. Those parts and elements which have been described above make up the central work processing section of the multi-function machine, including the drive power supplies, controls, and driven parts, Below the above-described central work processing section, which is enclosed by the yoke 8, is a vibratory mass separator 43, which is known per se. The vibratory mass separator 43 includes a mass separating sieve 44 which is located just below the barrel containers and extends toward its work piece outlet. The mass separating sieve 44 is of width and length that are sufficient to allow the sieve to receive the total amount of mass from all the barrel containers at a time (as shown in FIG. 1). The abrasive media which is separated through the sieve 44 from the processed work pieces is collected into a media collecting receptacle 46 (FIG. 6) which is located below the sieve 44, extending along the mass traveling passage of the sieve 44. The media receptacle 46 has two media outlet ports 48 and **48*a* as shown in FIG. 1, through which the media is collected back into buckets 53 and 53*a* below the outlet ports 48 and 48*a*. As shown in FIG. 2, a motor 47 is provided below the mass separating sieve 44** which is vibratably supported by a plurality of springs, causing the vibration of the sieve.

Figure 3:
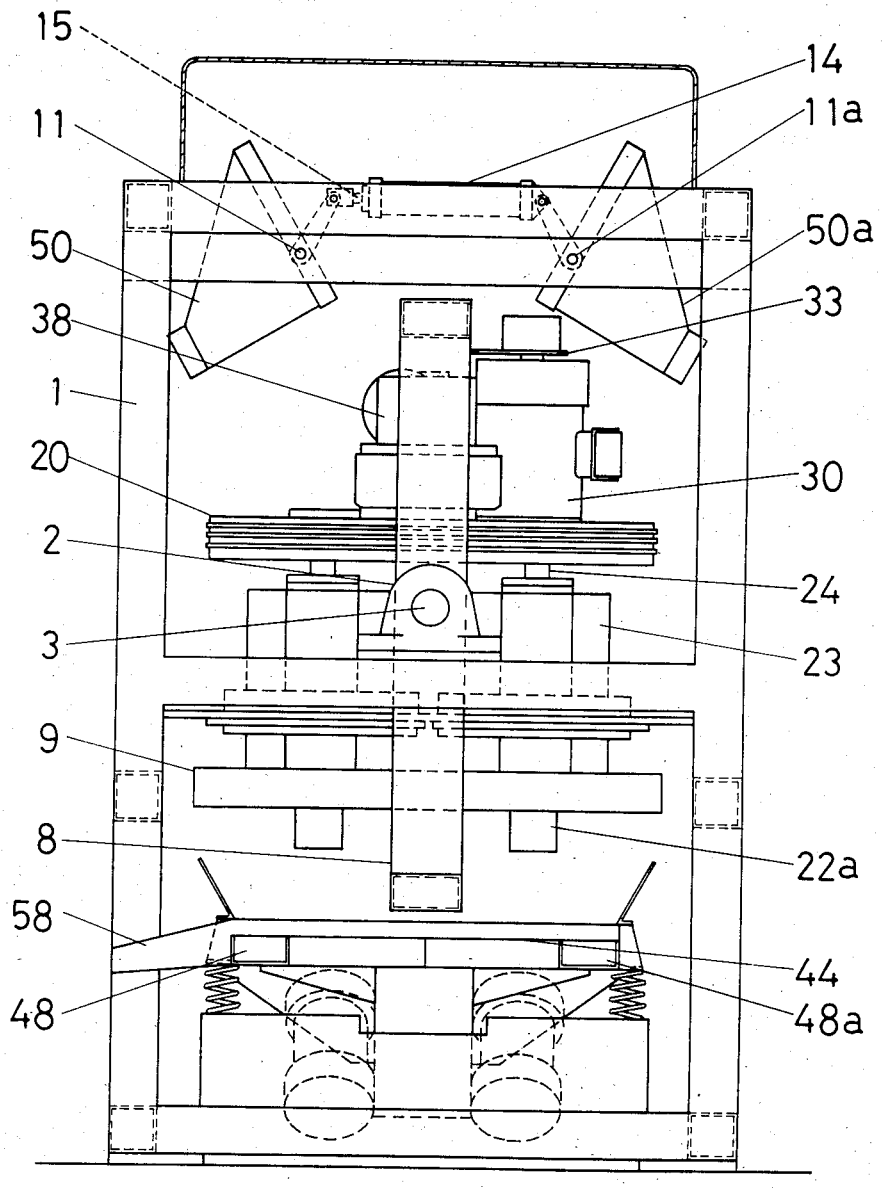
FIG. 3 is a side elevation of the machine in FIG. 1.
Figure 6:
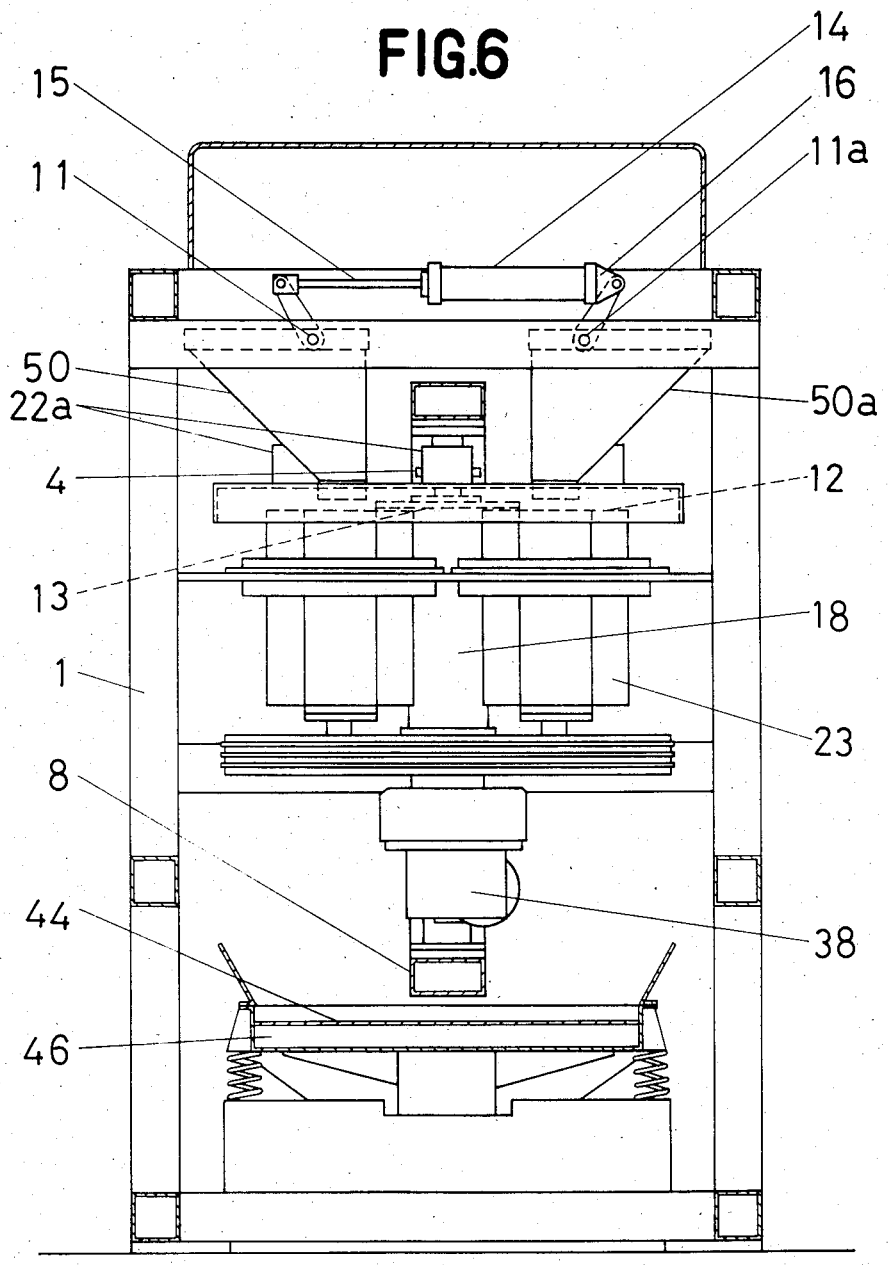
FIG. 6 is a side view of a yoke within which the work processing section is accommodated and which is shown to be placed in its reversed position.

A mass charge section which is generally designated by 51 as shown in FIG. 2 is provided above the central work processing section, and includes a pair of input chutes 50 and **50*a*, and a bucket conveyor 49 which travels between the input chutes and the media outlet ports 48 and 48*a*. As shown in FIGS. 3 and 6, one of the pair of the chutes, which in the example shown is represented by 50, is connected to the piston rod 15 of a fluid-operated cylinder 14 by means of a link, one end of which is pivotally connected to the chute by means of a pin 11 and the other end of which is connected to the piston rod 15. Similarly, the other chute 50*a* is pivotally connected to the rear end of the cylinder 14 by means of a link which is pivotted on a pin 11*a* on the chute 50*a*. Each chute is internally divided into two sections, each having an outlet port 52 and 52*a* at the bottom, as shown in FIG. 2. The buckets 53 and 53*a* are coupled by means of a connecting rod 54, and travel from the position below the outlet ports 48 and 48*a* up to the position above the input chutes 50 and 50*a* (FIGS. 1, 2 and 3). The bucket conveyor 49 includes conveying members such as chains 55, which are driven by a motor 56** for causing the buckets to travel.

As readily understood from the foregoing description, the embodiment includes the central work processing section which is accommodated within the tiltable yoke, and the multiple work processing functions are provided by varying the angle of the main spindle traversing the tiltable yoke. The multiple work processings functions may be provided by employing an alternative design, which will be described in detail later. In this alternative construction, the central work processing section is enclosed within a pair of rolling plates which are movably supported on pairs of rollers. The angle of the main spindle may be varied by causing the motor to drive the rollers for rotation. In this way, the multiple work processing functions may be provided. It should be understood that this solution is covered by the concept of the present invention.

The operation of the machine as described above is now described. The machine proposed by the present invention incorporates the multiple work processing functions provided by those individual machines which include the horizontal-type high-speed centrifugal barrel finishing machine, vertical-type high-speed centrifugal barrel finishing machine, horizontal-type rotating barrel finishing machine, and tiltable-type rotating barrel finishing machine. As has been described, the functions which may be selected depends upon the work processing requirements. Thus, two typical examples of the sequential work processing are presented in order to enable any person skilled in the art to fully understand the concept of the present invention. In one example, the horizontal-type high-speed centrifugal barrel finishing process is first selected during which work pieces are to be finish-processed with high efficiency after which by the horizontal-type rotating barrel finishing process is selected during which the work pieces are further finish-processed with precision. In the second example, where objects to be finished are work pieces made of relatively fragile materials such as ceramics, the tiltable-type rotating barrel finishing process is first selected during which the preliminary steps of removing any burrs from the work piece surfaces (deburring) and slightly rounding the corners of the work pieces (radiusing) are to take place after which the vertical-type high-speed centrifugal barrel finishing process is selected during which the final radiusing and surface finishing steps are to take place.

Figure 7:
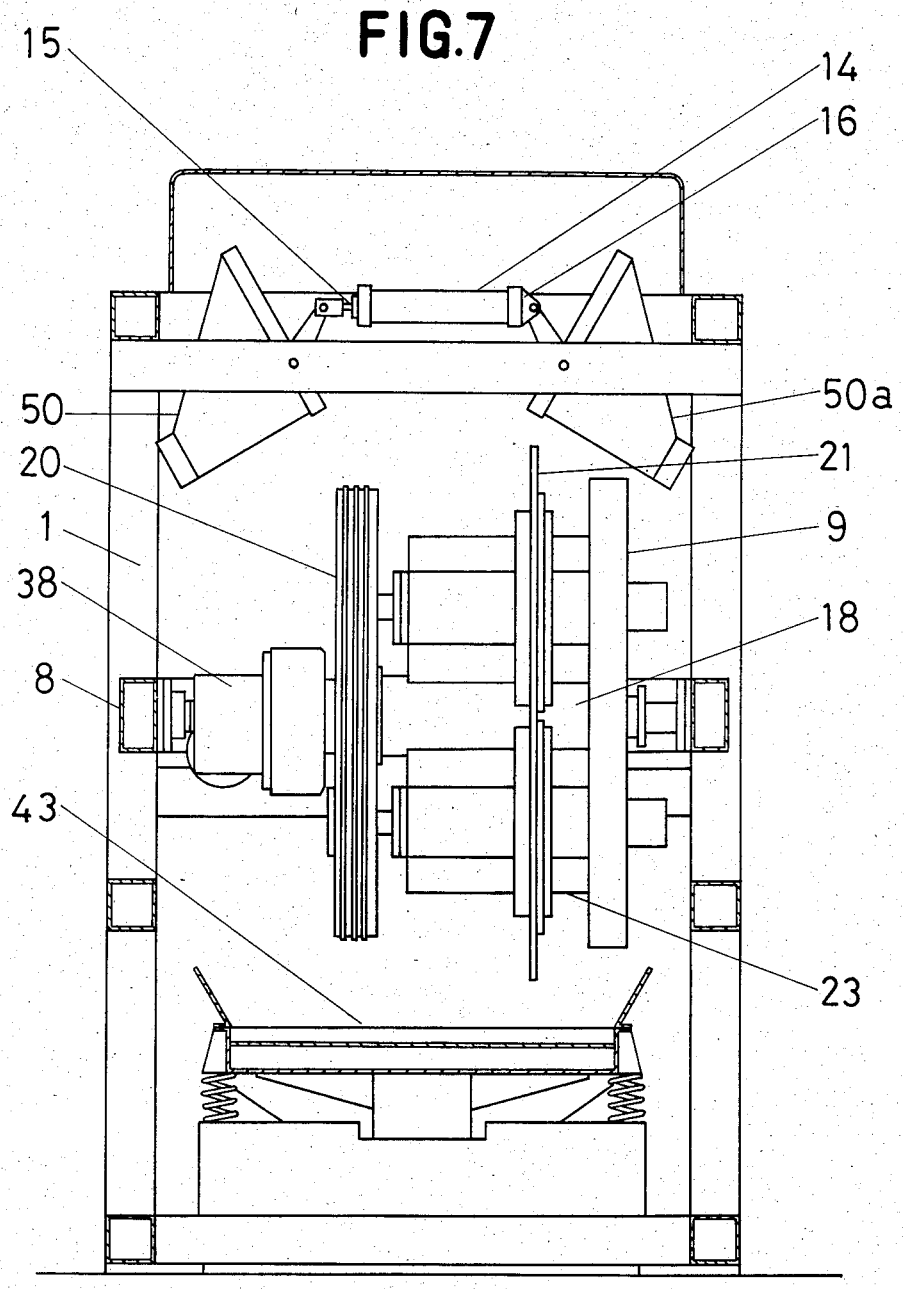
FIG. 7 is a side view of the yoke which is shown to be placed in its horizontal position.

In the first example, the processing stages consisting of the horizontal-type centrifugal barrel finishing process followed by the horizontal-type rotating barrel finishing process are described as follows. For the convenience to simplify the description, is assumed that initially the individual barrels 23 containing appropriate quantities of work pieces to be processed and their abrasive media, including water and compound if required, are placed in their horizontal positions with the chutes 50 and 50*a* in their retracted positions, as shown in FIG. 7. In the initial conditions, the yoke 8 is held by the corresponding engaging member in the angular position that places the main spindle 18 in its horizontal position. Then, the main motor 30 is started with the electromagnetic clutch on the sprocket 33 deenergized (OFF). Starting the motor 30 causes the drive wheel 20 and then the turret 21 to rotate. The barrels 23 carried by the turret 21 are then rotating on their axes while revolving about the main spindle 18. When the number of orbital revolutions of any given barrel is represented by N, and the number of axial rotations is represented by n, their ratio represented by n/N should be selected such that n/N is equal to $-1$, which is the most adequate value. In this case, the motor 37 for causing the axial rotation of the barrels is stopped. The number of orbital revolutions for the barrels should be set to $(60\ 200)/\sqrt{2R}$ per minute, preferebly $(100\ 160)/\sqrt{2R}$ per minute, where R is the radius (m) of orbital revolution about the center of which the barrels are traveling in orbital motion. The choice of either of the above value ranges should provide the best results. In this manner, the barrels 23 are traveling in orbital motion about the horizontally-disposed main spindle 18 while rotating on their axes during the first high-speed centrifugal barrel finishing stage, and the work pieces are subjected to the high-efficiency finish-processing.

When the first stage is completed, the main motor 30 is stopped and then the motor 37 for causing the axial rotation of the barrels is started. The following stage during which the horizontal-type rotating barrel finishing process takes place begins by starting the motor 37, which causes the axial rotation of the barrels. In this case, the number of axial rotations for any given barrel should be set to $(15\ 30)/\sqrt{2r}$ per minute, or preferably $(18\ 20)/\sqrt{2r}$ per minute, where r is the radius (m) of the inscribed circle of a barrel. The choice of either of the above value ranges should also provide the best results. When the second stage is completed, the motor 37 is stopped.

Then, the yoke 8 is disengaged from the engaging member which places the yoke in its horizontal position, and the yoke indexing motor 5 is then started, causing the main spindle 18 to rotate to its vertical position as indicated by FIGS. 2 and 3. When the main spindle is placed in its vertical position, the motor 5 is stopped and the yoke 8 which is also placed in its vertical position is engaged with the corresponding engaging member which holds the yoke in that position.

After holding the yoke in the position, the electromagnetic clutch on the sprocket 33 is engerized (ON), and the brake-controlled geared motor 35 is driven to transmit driving power from motor 35 to motor 30. The motor 35 causes the turret 21 to have an indexing motion, which places the barrels below the outlet ports 52, 52*a* of the chutes 50, 50*a* such that the central axes traversing the barrels are aligned with those of the corresponding outlet ports 52, 52*a*. When the barrels are properly placed, a pressurized fluid is introduced into the piston sides of the fluid-operated cylinders 7, 7. This action retracts the mounting plate 4 away from the turret 21 so that the openings 12 of the barrels 23 are released from the holding pressure of the lids.

The next step in the sequence is bringing the roller 28 into contact with the lateral side of the rotary panel 9 and then starting the barrel lid indexing motor 41. Those actions cause the rotary panel 9 and the barrel lids 13 supported by the rotary panel to rotate about the main spindle 18 through an angle of 45 degrees. Thus, the barrel lids 13 are displaced in the horizontal direction away from the openings 12 of the corresponding barrels 23, leaving the openings free. Then, the mass in the barrels 23 are allowed to fall through the openings 12 and the cutouts 57 formed in the rotary panel 9 onto the mass separating sieve 44 below. This is done for all the barrels (four barrels in this example). At the same moment, the motor 47 for causing the vibration of the sieve 44 is started. This places the sieve 44 under vibration, and the mass on the sieve is separated into the processing work pieces and their abrasive media. The work pieces are traveling toward their outlet port 58, through which they are collected into the work collecting container (not shown), while the media are allowed to fall through the sieve onto the media collecting respectacle 46 below and are collected through the outlet ports 48 and 48*a* into the buckets 53 and 53*a*. During the media collecting process, an additional number of work pieces to be processed next are placed into the buckets 53 and 53*a*.

Next, the yoke 8 is disengaged from the engaging member now holding it in its vertical position, and the yoke indexing motor 5 is driven with the openings 12 of the barrels 23 free of their lids. Thus, the yoke shafts 3 and 3*a* are driven for indexed rotation through an angle of 180 degrees, reversing the position of the yoke 8. After that, a pressurized fluid is introduced into the piston side of the fluid-operated cylinder 14, causing the chute 50 and 50*a* to have a pivotted motion by means of their links so that they are placed in the positions as indicated in FIG. 6, where the chutes 50 and 50*a* have the outlet ports 52 and 52*a* facing the openings 12 of the barrels 23. In this state, the yoke 8 is engaged with the corresponding engaging member, which holds the yoke in its reversed position.

After all of the required media and work pieces have been contained in the buckets, in the meantime, the motor 56 is started, causing the buckets 53 and 53*a* to travel up to the position where the chutes 50 and 50*a* are located. Above the chutes, the buckets are reversed, allowing the content to be thrown into the chutes. As each of the chutes is divided into the two sections, the content in each bucket is distributed into the two section of each corresponding chute. Thus, the distributed portion of the content in each section is thrown through the outlet ports 52, 52*a* into the corresponding barrels 23. When the transfer of the content into the barrels is completed, the chutes 50 and 50*a* are again pivotted back to their positions as indicated in FIG. 3. Then, the barrel lid indexing motor 41 is again started, causing the rotary panel 9 carrying the barrel lids 13 to have an indexed motion so that the barrel lids can be placed in the positions above the openings 12 of the corresponding barrels 23. When the lids are properly placed, a pressurized fluid is introduced into the piston side of the cylinders 7, 7, acting upon the mounting plate 4 to move the rotary panel 9 closer to the barrels, thereby pressing the lids against the corresponding openings 12. Thus, the barrels are hermetically sealed. This concludes one cycle of the two-stage finishing sequence.

The second example in which the two-stage sequence consists of the tilted-type rotating barrel finishing process followed by the vertical-type high-speed centrifugal barrel finishing process is next described. The following description is only limited to those operations specific to this example, since the other associated operations occur in a similar manner as those in the preceding example. It is assumed that initially, the barrels 23 contain the work pieces to be processed and their abrasive media, and are placed in their tilted position. In this tilted position, the yoke 8 engages the corresponding engaging member that places the main spindle 18 in its inclined position. The tilting angle of the main spindle should be in the range of 20–50 degrees, or preferably in the range of 30–40 degrees, with regard to the horizontal plane. The choice among those angles should provide the best results. The first step is to start the motor 37 for causing the axial rotation of the barrels 23. This starts the first-stage tilted-type rotating barrel finishing sequence. As mentioned earlier, this type of rotating barrel finishing process is suited to the deburring process as compared with the horizontal-type rotary barrel finishing process, since this method provides the smooth flow of the total mass. Thi method may also be used with those kinds of work pieces which would tend to stick on to the end sides of the inner barrel wall when the horizontal-type method is used. When the first-stage sequence is completed, the motor 37 is stopped and the yoke indexing motor 5 is then started. Driving the motor 5 causes the yoke 8 to have an indexed motion. The motor 5 is stopped when the barrels 23 have their openings 12 facing down as indicated in FIGS. 2 and 3 and the main spindle 18 is placed in its vertical position. Then, the main motor 30 is started. The motor 30 drives the turret carrying the barrels 23 for rotation, thus causing the barrels to revolve about the main spindle 18. As the barrels start to revolve, the mass is gradually rising along the outer peripheral wall inside the barrels. This type provides an advantage over the horizontal-type of the same finishing process in that less impact on the mass is produced at the time of start-up and stop. When the second-stage sequence is completed, the main motor 30 is stopped. Then, the brake-controlled geared motor 35 is started, driving the turret 21 for the indexed motion which places the barrels in their proper positions where the mass is to be discharged. In those positions, the mass is allowed to fall onto the mass separating sieve 44 as described in the preceding example. The processed work pieces are collected through the work outlet port 58, and the media are collected back into the buckets 53 and 53*a* and are reused with the work pieces to be processed next.

Following the above two-stage sequence, the yoke 8 with the barrels 23 is reversed facing the barrel openings 12 to face the chutes 50 and 50*a* above. Then, the buckets 53 and 53*a* are moved up to the chute 50 and 50*a*, from which the mass is delivered into the barrels. After that, the barrels are reclosed by the lids 13. This concludes one cycle of the two-stage sequence.

The present embodiment that has been described with the two examples illustrating how the operation takes place allows the central work processing section supported by the main spindle to be tilted by varying the angle of the main spindle, such as from horizontal to vertical or tilted positions and vice versa, depending upon the particular work processing requirements. As such, a single machine construction provides a wide range of choices among the various functions offered by the different independent machines that have been listed as a major consideration of the present invention. The total automatic system may be implemented by including the optional means that allows for automatic lid opening and reclosing for all barrels as well as the mass charge means and mass separator means.

Figure 8:
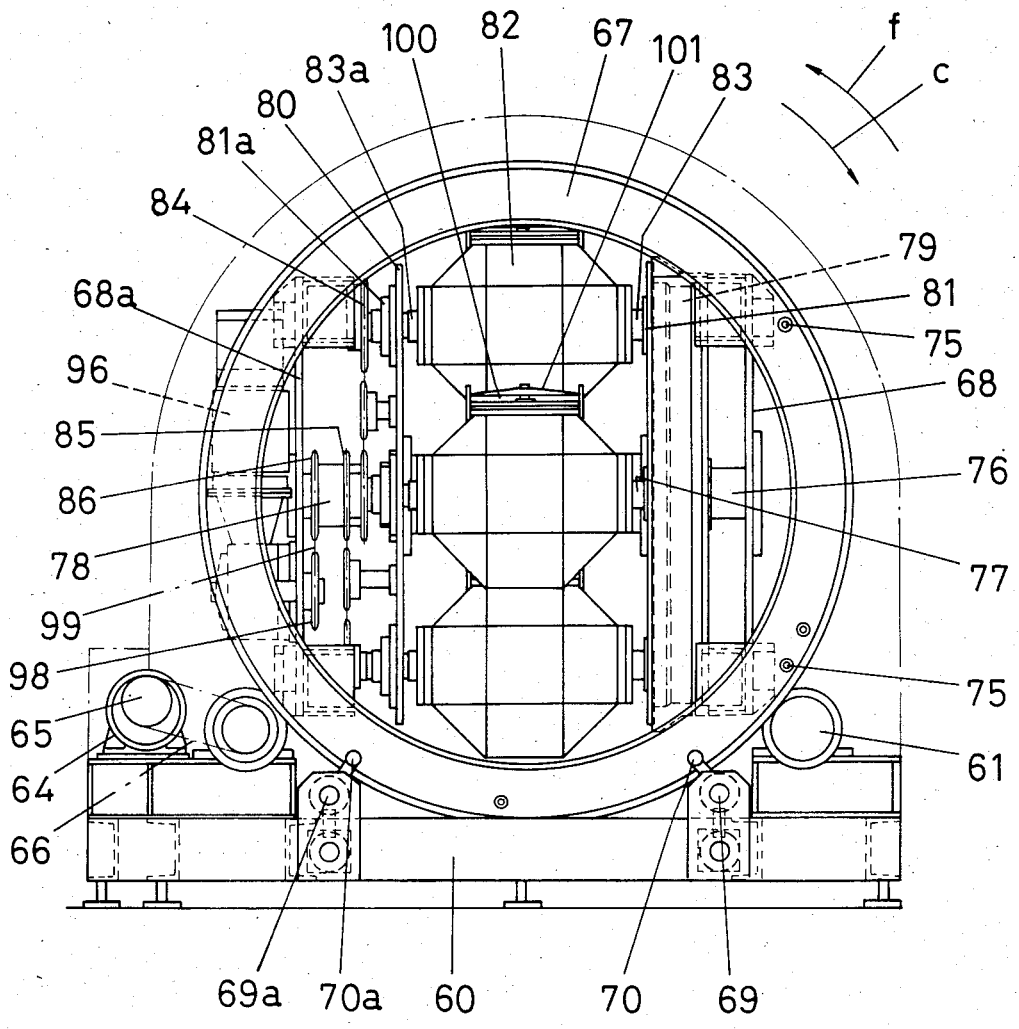
FIG. 8 is a front elevation of a variation of the machine shown in FIG. 1, in which the optional means of automatic lid opening and closing for the barrels is not provided.
Figure 9:
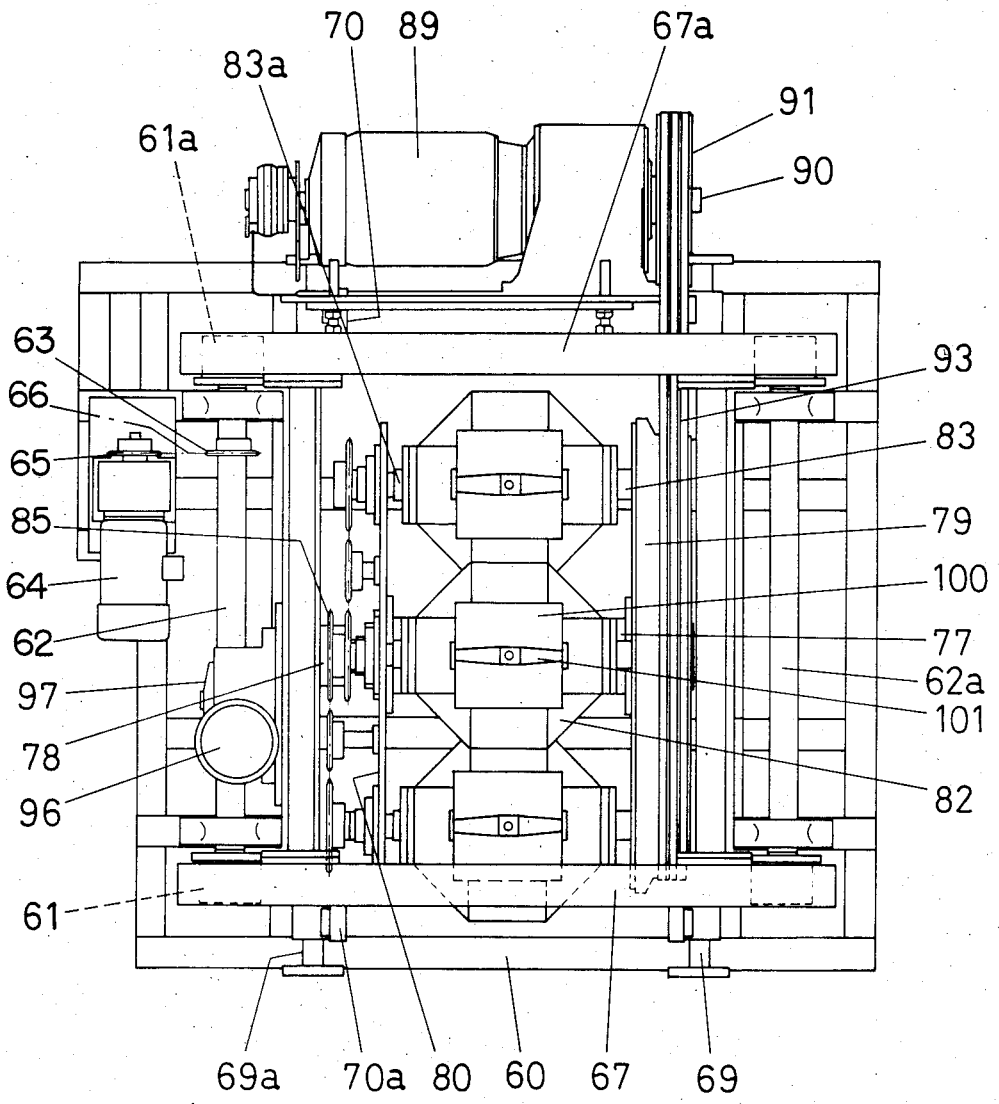
FIG. 9 is a plan view of the machine in FIG. 8.
Figure 10:
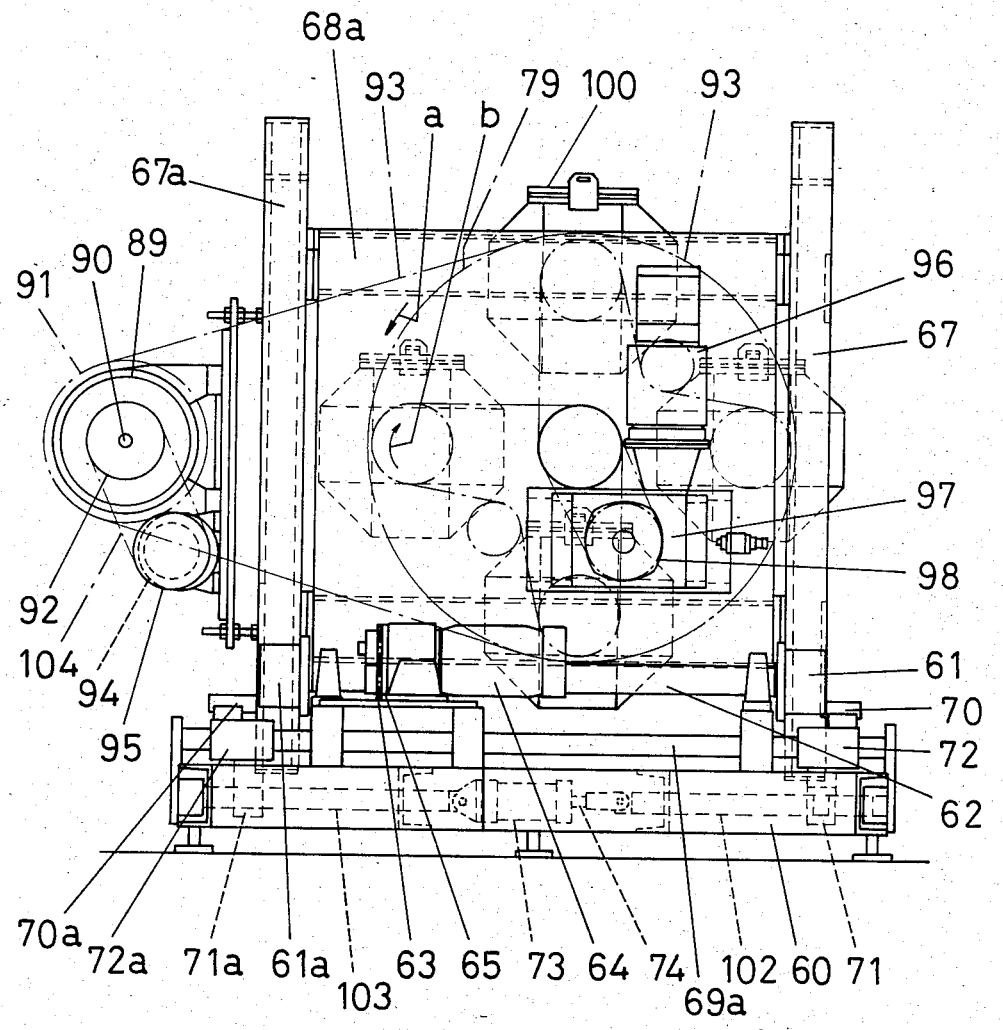
FIG. 10 is a side elevation of the machine in FIG. 8.
Figure 11:
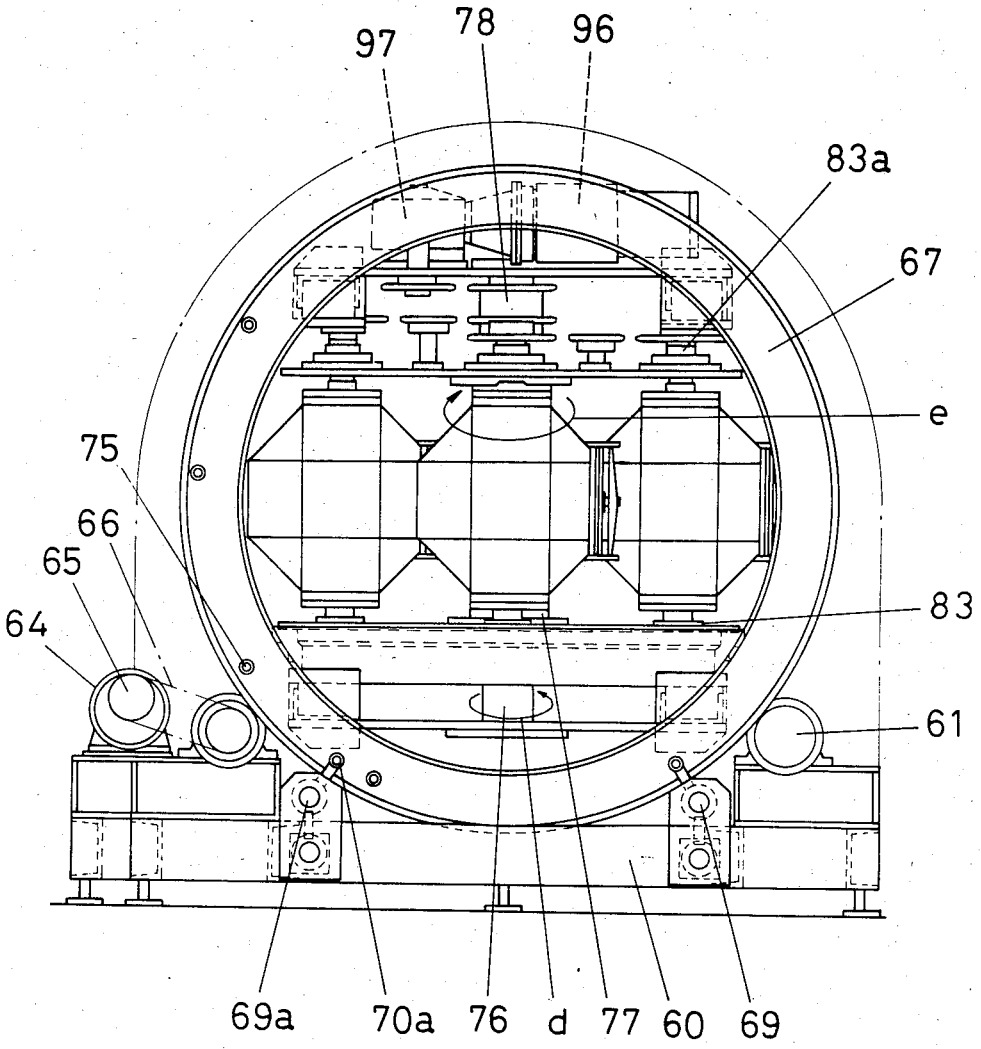
FIG. 11 is a front view of the machine of FIG. 8, in which the main spindle is shown to assume its vertical position.

A variation of the preceding embodiment in which the optional automatic lid opening and reclosing means is not provided is now described by referring to FIGS. 8 through 14. A central work processing section forming the principal portion of the machine is supported on a machine pedestal 60, and has the following construction. A pair of rods of round cross-section 62, 62*a* each having rollers 61, 61*a* at the opposite ends are supported on the pedestal 60 and are arranged across the pedestal, extending in parallel with each other in the longitudinal direction thereof. One of the rods, which is shown by 62, has a sprocket 63, which is linked to a sprocket 65 on a geared motor 64 mounted on the pedestal 60, by means of a sprocket chain 66 which threads both sprockets. Thus, the drive power from the geared motor 64 is transmitted through the chain and sprockets to the rod 62 so that it can be driven for rotation. A pair of rolling plates 67, 67*a* are rotatably supported on the pairs of rollers 61, 61*a*. A pair of lateral plates 68, 68*a* are arranged in parallel across the pair of rolling plates 67, 67*a* and are rigidly fixed to the rolling plates. The members described above make up the rolling frame structure. Another pair of rods of round crosssection 69, 69*a* are fixed on the pedestal 60, extending in parallel with the corresponding rods 62, 62*a* across the pedestal. Each of the rods 69 and 69*a* has a housing 72, 72*a* at one end thereof, which is fitted around the corresponding rod slidably in the longitudinal direction, each of the housings having an engaging member 70, 70*a* at the top and a boss 71, 71*a* at the bottom (FIG. 10). At the bottom of the pedestal 60, a fluid-operated cylinder 73 is disposed horizontally and movably in the traverse direction of the pedestal in FIG. 10.

The fluid-operated cylinder 73 has an extensible and retractable piston rod 74, to the forward end of which a connecting rod 102 is linked at one end thereof pivotally through small angles. The other end of the connecting rod 102 is supported by a bearing on the pedestal. The boss 71 of the housing 72 is secured to the connecting rod 102 at the position nearer to the bearing. At the rear of the cylinder 73, a connecting rod 103 is linked at one end thereof to the cylinder pivotally through small angles. The other end of the connecting rod 103 is supported by a bearing on the pedestal, and the boss 71*a* of the housing 72*a* is secured to the connecting rod 103 at the position nearer to the bearing. As such, introducing a pressurized fluid into the piston side of the cylinder 73 causes its piston rod 74 to move forward, so that the housings 72 and 72*a* can be slidably moved by the action of the corresponding bosses 71 and 71*a* outwardly along the rods 69 and 69*a*. Introducing a pressurized fluid into the piston rod side of the cylinder 73 has the reverse action, which causes the piston rod 74 to be retracted, thus making the housings 72 and 72*a* slide inwardly along the rods 69 and 69*a*. The rolling plates 67 and 67*a* have tapered apertures 75, 75 at appropriate positions around the outer circumference thereof, which are to be engaged by the engaging members 70, 70*a*. The interaction between those tapered apertures and engaging members is shown in FIG. 8. A central shaft 76 across the lateral plates 68 and 68*a* has the opposite ends thereof secured to the corresponding plates. A main spindle 77 is fitted around the middle portion of the central shaft 76 and is rotatable with respect to the shaft 76. The central shaft 76 has a planetary wheel drive wheel 78 on one end thereof, which is rotatably fitted around the shaft 76 (FIG. 8). The main spindle 77 has a turret drive wheel 79 and a round-shaped turret 80, which are secured to the main spindle on the opposite sides thereof. The turrent drive wheel 79 has a plurality of bearings 81 (four are shown in FIG. 10) which are arranged at equally spaced positions around the same circumference of a wheel, and the turret 80 has the corresponding number of bearings 81*a* at positions corresponding to those of the bearings 81 on the turret drive wheel 79. The bearings 81, 81*a* rotatably support the corresponding barrel shafts 83, 83*a* which are extended from the opposite sides of barrels 82. Each of the barrel shafts 83*a* has its driving wheel 84 rigidly secured to the end thereof. The planetary wheel driving wheel 78 (FIG. 8) has a barrel driving wheel 85 which drives half the number of the barrels 82 and an associated wheel 86 which drives the planetary wheel drive wheel 78. A similar barrel driving wheel (located below barrel wheel 85 in FIG. 9) drives the remaining barrels 82.

Figure 13:
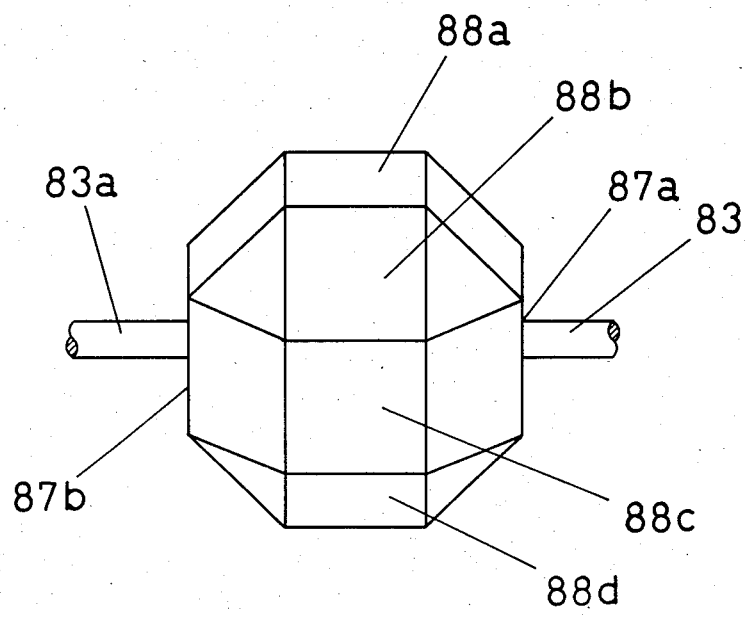
FIG. 13 is an enlarged front view of a barrel-form container, showing its geometrical configuration.
Figure 14:
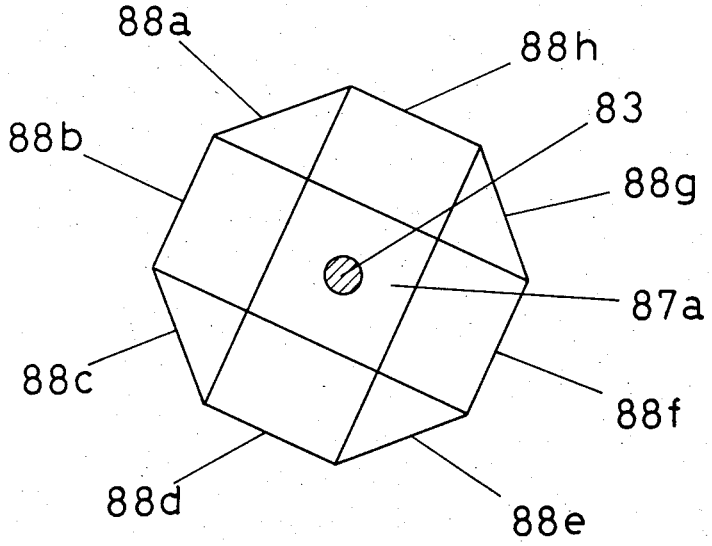
FIG. 14 is an enlarged side view of the same as shown in FIG. 13.

Each of the barrels 82 has an equilateral polygonal cross-section and is configured, as shown in FIGS. 13 and 14, such that it includes sides 87*a* and 87*b* from which the barrel shafts 83 and 83*a* extend and which have a square form in the plane perpendicular to the barrel shafts, and outer circumferential sides 88*a*, 88*b*, 88*c*, 88*d*, 88*e*, 88*f*, 88*g*, and 88*h* all of which have an identical square form and are arranged in parallel with the shafts 83, 83*a* with between the angle the adjacent sides being 135 degrees. This configuration provides an improved work finishing efficiency, because it presents the same form when viewed from the plan, front, and lateral sides as shown in FIGS. 13 and 14 and all the sides provide the proper stirring action for any type of the rotating barrel finishing, as well as the horizontal-type and vertical-type high-speed centrifugal barrel finishing processes. Therefore, the thus configured barrel allows for the above three different types of processes to be performed sequentially. It should be understood, however, that the barrel may be configured to present any cross section such as from pentagonal to octagonal and spherical shapes.

The number of the barrels 82 supported by both the turret driving wheel 79 and turret 80 may be two or more. Usually, four barrels are used, and in this case they are arranged symmetrically. One of the rolling plates, which for example is shown by 67, is doughnut-shaped to allow for the manual operation on the front side, while the other rolling plate 67*a* is blind. The rolling plate 67*a* has a main motor 89 and a brake-controlled geared motor 94 for causing the indexing motion of the turret, both motors being rigidly fixed to the lateral side of the rolling plate 67*a*. The main motor 89 has an output shaft 90, to which a pulley 91 and an electromagnetic clutch controlled sprocket 92 are secured. A connecting belt 93 threads the pulley 91 and the turret driving wheel 79, so that the driving power from the main motor 89 is transmitted through the belt 93 to the turret driving wheel 79. The electromagnetic clutch controlled sprocket 92 is driven by a chain 104 which threads a sprocket 95 on the brake-controlled geared motor 94. The lateral plate 68*a* carries a brake-controlled motor 96 for causing the axial rotation of the barrels, which is coupled to a speed shifter 97. The speed shifter 97 has an output shaft to which a wheel 98 is secured, and the wheel 98 is linked by means of a chain 99 to its associated wheel 86. Each of the barrels 82 has a removable lid 100 which includes a clamp bar 101 for fastening the lid in position.

The operation of the second embodiment is now described in accordance with the construction that has been illustrated hereabove. Similary to the preceding embodiment, this embodiment provides the various functions offered by the individual machines that have been listed in the previous embodiment, which may be selected and performed singly or in any combination, depending upon the particular work finishing needs. For ease of understanding of the concept of this embodiment, two methods are presented, the first method consisting of the horizontal-type high-speed centrifugal barrel finishing process followed by the horizontal-type rotating barrel finishing process, and the second method consisting of the vertical-type high-speed centrifugal barrel finishing process followed by the tilted-type rotating barrel finishing process.

The case for the first method is now described, and it is assumed that the barrels and other associated parts are initially placed at the positions as indicated in FIGS. 8 and 9, from which the operation is to start. In their initial positions, the rolling plates 67 and 67*a* are held by the engaging members 70 and 70*a* so that the main spindle 77 is maintained in its horizontal position. Each of the barrels 82 contains appropriate quantities of work pieces to be processed and their abrasive media, which may include water and compound if required, and is hermetically closed by the lid 100 by tightening the clamp bar 101. Then, the brake-controlled geared motor 94 is driven with the electromagnetic clutch on the sprocket 92 activated (ON). The motor 94 causes the indexing motion of the turret 80, placing all barrels 82 in their ready positions. When all the barrels are readied, the electromagnetic clutch on the sprocket 92 is deenergized (OFF) and the main motor 89 is started. This causes the rotation of the turret 80 in the direction of an arrow a (counterclockwise) as shown in FIG. 10, that is, in a direction perpendicular to the axis of the main spindle. The individual barrels 82 rotate with the turret which is driven by belt 93, revolving about the main spindle 77 while turning on the barrel shafts 83 for axial rotation in the direction of an arrow b in FIG. 10. The ratio of the number of orbital revolutions N to the number of axial rotations n for the barrels 82, which is represented by n/N, may be selected as desired, by adjusting the output speed, or number of revolutions, of the motor 96 by means of the speed shifter 97. The optimum choice is, however, the n/N value which is equal to $-1$ with the motor 96 stopped. In this case, the number of orbital revolutions of any given barrel 82 should be in the range of $(60\sim200)/\sqrt{2R}$ per minute, or preferably in the range of $(100\sim160)/\sqrt{2R}$ per minute, where R is a radius (m) of orbital revolution of the barrel. Choosing either of the ranges should provide the best results. Both the orbital revolution and axial rotation of the barrels 82 occuring at high speeds produce well-finished work pieces. When the first-stage processing is completed, the main motor 89 is stopped, and in turn the motor 96 is started. In this case, the number of axial rotations of the barrels 82, which are driven by the motor 96, may be controlled by the speed shifter 97. This number should have the range of $(15\sim30)/\sqrt{2r}$ per minute, or preferably the range of $(18\sim25)/\sqrt{2r}$ per minute, when r is the inscribed circle radius (m) of the barrel. These ranges provide the best results. When the second-stage processing is completed, the motor 96 is stopped, and the brake-controlled geared motor 94 is then driven with the electromagnetic clutch on the sprocket 92 turned on. This action causes the indexing motion of the turret 80, placing any of the barrels 82 at any position where the turret is stopped. Then, the lid 100 is demounted from that barrel by loosening the clamp bar 101. This allows the mass to be removed from the barrel. The same procedure is repeated for the remaining barrels. By now, one cycle of the two-stage sequence is concluded.

The second case is next described. In their initial positions as shown in FIGS. 8 and 9, each barrel 82 contains appropriate quantities to work pieces to be processed and their abrasive media, which may include water and compound if required, and is hermetically closed by the lid 100 by tightening the clamp bar 101. Then, the brake-controlled geared motor 94 is driven with the electromagnetic clutch on the sprocket 92 activated (ON). The motor 94 causes the indexing motion of the turret 80, placing all barrels 82 in their ready positions. When all the barrels are prepared, the electromagnetic clutch on the sprocket 92 is deenergized (OFF). Then, a pressurized fluid is introduced into the piston side of the fluid-operated cylinder 73. This action disengages the tapered apertures 75 on the rolling plates 67 and **67*a* from the corresponding engaging members 70, 70*a* which are holding the rolling plates in their fixed positions. Thus, the rolling plates 67 and 67*a* are allowed to roll on the rollers 61, 61*a*. In this state, the geared motor 64 is driven causing the rolling plates 67 and 67*a* to rotate in the direction of an arrow c (clockwise) in FIG. 8 until the main spindle 77 is placed in its vertical position, where the motor 64 is stopped. Then, a pressurized fluid is introduced into the piston rod side of the cylinder 73. This action causes the engaging members 70 and 70*a* to engage the corresponding tapered apertures on the rolling plates, which are located at the positions that place the main spindle in its vertical position. Thus, the rolling plates 67 and 67*a* are held in position. After this, the main motor 89 is started. Starting the main motor causes the turret 80 to rotate in the direction of an arrow d in FIG. 11, that is, in the horizontal direction, the barrels 82 supported by the turret rotating on their axes 83 in the direction of an arrow e in FIG. 11**. As a result, the individual barrels have both the orbital revolving and axial rotating actions, which occur in the horizontal direction. Therefore, the work pieces in the barrels are subjected to those actions. When the barrels are subjected to such horizontal actions, the mass in each individual barrel are gradually rises along the outer peripheral wall inside each barrel, which is formed by the line of revolution around the main spindle. In this way, less impact on the work pieces being processed is produced than for the barrels revolving in the vertical direction, at the time of start-up and stop.

Figure 12:
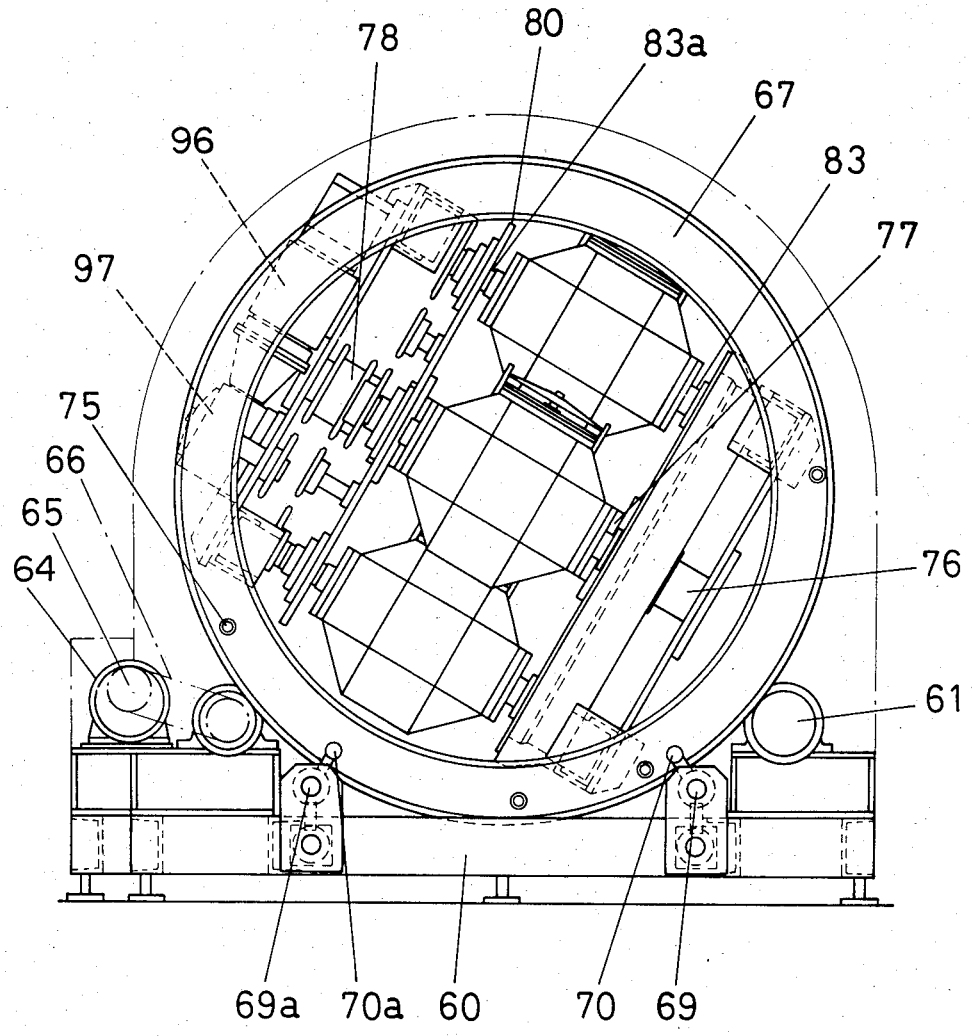
FIG. 12 is a front view of the machine in FIG. 8, in which the main spindle is shown to assume its inclined position.

When the first-stage processing is completed, the main motor 89 is stopped. Then, a pressurized fluid is introduced into the piston side of the cylinder 73, and the geared motor 64 is driven. These actions cause the rolling plates 67 and **67*a* to roll in the direction of an arrow f (counterclockwise) in FIG. 8, until the main spindle 77 is placed in its tilted position as indicated in FIG. 12, where the motor 64 is stopped. Then, the rolling plates are held in their fixed positions in the same manner as described above. Following this, the motor 96 is started. The tilted position of the main spindle should be at an angle in the range of 20 and 50 degrees, or preferably in the range of 30 and 40 degrees, with respect to the horizontal plane. These angle ranges should provide the best results. This second-stage processing which consists of causing the axial rotation of the barrels 82 with their shafts 83 tilted is effective even for the kind of work pieces that would tend to stick on to the top and bottom sides inside the barrel when the horizontal-type rotary barrel finishing machine is used. When the second-stage sequence is completed, the motor 96 is stopped, and then the rolling plates 67 and 67*a* are released from their engaging members 70 and 70*a* as described in the preceding stage and are rolled counterclockwise (as indicated by an arrow f in FIG. 8) until the main spindle 77 is restored to its original horizontal position as shown in FIG. 8, where the plates are stopped. Next, the electromagnetic clutch on the sprocket 92 is turned ON, and the brake-controlled geared motor 94 is driven. Driving the motor 94 causes the indexing motion of the turret 80, until any of the barrels carried by the turret is placed at its proper position when the motor 94 is stopped. The lid 100 for that barrel is removed by untightening the clamp bar 101**. This allows the mass to be removed from the barrel. The same procedure is repeated for the remaining barrels. This concludes one cycle of the two-stage sequence.

In the second embodiment that has been described, the motor 96 coupled with the speed shifter 97 is used to adjust the number of axial rotations of the barrels, but a frequency inverter may be used to control the speed electrically.

The two typical embodiments of the present invention have been described in detail. As readily understood from those foregoing descriptions, the present invention provides a wide range of functions in a single machine construction, which have been offered by the individual machines of the kinds mentioned herein.

Although the invention has been described by way of the several examples, it should be understood that various changes and modifications may be made without departing from the scope and spirit of the invention.

What are claimed are:

1. A multi-function barrel finishing apparatus comprising:

a machine pedestal;

a main spindle pivotably mounted on said machine pedestal, said main spindle having a central axis and being rotatable about said central axis;

first and second rollers rotatably mounted on said machine pedestal, said first and second rollers being connected by a first shaft;

third and fourth rollers rotatably mounted on said machine pedestal, said third and fourth rollers being connected by a second shaft which is parallel to said first shaft;

a first rolling plate rotatably supported by said first and third rollers;

a second rolling plate rotatably supported by said second and fourth rollers, said second rolling plate being parallel to said first rolling plate;

a pair of parallel lateral plates extending between said first and second rolling plates, said lateral plates rotatably supporting said main spindle;

means for rotating at least one of said rollers to thereby pivot said main spindle to any one of a plurality of desired angular positions with respect to said machine pedestal;

a turret rotatably supported by said main spindle;

a plurality of barrels rotatably mounted on said turret, said barrels being rotatable about barrel axes which are offset from said central axis, each of said barrels having an equilateral polygonal cross-section;

barrel rotation means for rotating said barrels about said barrel axes;

turret rotation means for rotating said turret about said central axis, said turret rotation means being operable independently from said barrel rotation means; and means for and holding said main spindle at any one of a plurality of desired angular positions with respect to said machine pedestal.

2. The multi-function barrel finishing machine of claim 1, wherein said barrel rotation means includes a motor and reduction gears coupled to said motor.

3. The multi-function barrel finishing machine of claim 1, wherein each of said barrels includes a pair of square shaped sides which are perpendicular to a respective barrel axis and a plurality of square shaped sides which are parallel to said respective barrel axis.

4. A multi-function barrel finishing apparatus comprising:

a machine pedestal;

a main spindle pivotably mounted on said machine pedestal, said main spindle having a central axis and being rotatable about said central axis;

a turret rotatably supported by said main spindle;

a plurality of barrels rotatably mounted on said turret, said barrels having openings at one end thereof and being rotatable about barrel axes which are offset from said central axis, each of said barrels having an equilateral polygonal cross-section;

barrel rotation means for rotating said barrels about said barrel axes;

turret rotation means for rotating said turret about said central axis, said turret rotation means being operable independently from said barrel rotation means;

spindle indexing means for pivoting and holding said main spindle at any one of a plurality of desired angular positions with respect to said machine pedestal;

lid means for opening and closing said openings in said barrels simultaneously, said lid means including barrel lids for engaging said openings and a rotary panel supporting said barrel lids, said rotary panel having cutouts between said barrel lids for filling and emptying said barrels and said rotary panel being slidable along and rotatable about said main spindle;

means for charging work pieces to be processed and abrasive media into said barrels simultaneously; and means for receiving the work pieces and abrasive media from said barrels simultaneously and for separating the work pieces from the abrasive media.

5. The multi-function barrel finishing apparatus of claim 4, wherein said barrels are rotatably supported on bearing shafts mounted on said turret, said bearing shafts being arranged at equally spaced angular positions around and equi-distant from said central axis.

6. The multi-function barrel finishing apparatus of claim 4, wherein said spindle indexing means includes a yoke, said yoke rotatably supporting said main spindle, means rotatably supporting said yoke on said machine pedestal, and means for rotating said yoke to thereby pivot said main spindle to a desired angular position with respect to said machine pedestal.

7. The multi-function barrel finishing machine of claim 6, wherein said spindle indexing means includes a pair of parallel rolling plates, a pair of parallel lateral plates extending between said rolling plates, said lateral plates rotatably supporting said main spindle therebetween, two pairs of rollers rotatably supporting said rolling plates and means for rotating at least one of said two pairs of rollers to thereby pivot said main spindle to a desired angular position with respect to said machine pedestal.

8. The multi-function barrel finishing machine of claim 4, wherein said spindle indexing means is operable to pivot a tilted position at an angle in the range of 20–50 degrees with respect to a horizontal axis.

9. A multi-function barrel finishing apparatus comprising:

a machine pedestal;

a main spindle pivotably mounted on said machine pedestal, said main spindle having a central axis and being rotatable about said central axis;

a turret rotatably supported by said main spindle;

a plurality of barrels rotatably mounted on said turret, said barrels having openings at one end thereof and being rotatable about barrel axes which are offset from said central axis, each of said barrels having an equilateral polygonal cross-section;

barrel rotation means for rotating said barrels about said barrel axes;

turret rotation means for rotating said turret about said central axis, said turret rotation means being operable independently from said barrel rotation means;

spindle indexing means for pivoting and holding said main spindle at any one of a plurality of desired angular positions with respect to said machine pedestal, said spindle indexing means including a yoke, said yoke rotatably supporting said main spindle, means rotatably supporting said yoke on said machine pedestal, and means for rotating said yoke to thereby pivot said main spindle to a desired angular position with respect to said machine pedestal, said spindle indexing means also including a pair of parallel rolling plates, a pair of parallel lateral plates extending between said rolling plates, said lateral plates rotatably supporting said main spindle therebetween, two pairs of rollers rotatably supporting said rolling plates and means for rotating at least one of said two pairs of rollers to thereby pivot said main spindle to a desired angular position with respect to said machine pedestal;

lid means for opening and closing said barrels, said lid means including barrel lids and a rotary panel supporting said barrel lids, said rotary panel being slidable along and rotatable about said main spindle;

means for charging work pieces to be processed and abrasive media into said barrels; and means for receiving the work pieces and abrasive media from said barrels and for separating the work pieces from the abrasive media.

* * * * *

UNITED STATES PATENT AND TRADEMARK OFFICE

CERTIFICATE OF CORRECTION

PATENT NO. : 4,638,600

DATED : January 27, 1987

INVENTOR(S) : Hisamine Kobayashi et al

It is certified that error appears in the above-identified patent and that said Letters Patent is hereby corrected as shown below:

On the title page assignee should read

--(73) Assignee: Tipton Manufacturing Corporation --.

Signed and Sealed this

Eighteenth Day of August, 1987

*Attest:*

DONALD J. QUIGG

*Attesting Officer*

*Commissioner of Patents and Trademarks*